US007775915B2

(12) United States Patent
McCarthy

(10) Patent No.: US 7,775,915 B2
(45) Date of Patent: Aug. 17, 2010

(54) WATER DISK SPORTS GAME AND TARGET

(76) Inventor: Kevin McCarthy, 1125-205th Ave. NE., Sammamish, WA (US) 98074

( * ) Notice: Subject to any disclaimer, the term of this patent is extended or adjusted under 35 U.S.C. 154(b) by 146 days.

(21) Appl. No.: 12/283,557

(22) Filed: Sep. 12, 2008

(65) Prior Publication Data

US 2009/0069129 A1 Mar. 12, 2009

Related U.S. Application Data

(60) Provisional application No. 60/993,547, filed on Sep. 12, 2007.

(51) Int. Cl.
*A63B 67/00* (2006.01)

(52) U.S. Cl. ..... 473/466; 273/350

(58) Field of Classification Search ..... 473/588, 473/466, 46; 273/350, 338, 337
See application file for complete search history.

(56) References Cited

U.S. PATENT DOCUMENTS 3,350,097 A * 10/1967 Chevrette et al. ..... 273/350
3,430,958 A * 3/1969 Lakeman ..... 473/481
3,652,090 A * 3/1972 Semmens ..... 273/336
3,710,505 A * 1/1973 Linenfelser ..... 446/46
3,778,060 A * 12/1973 Lakeman ..... 273/342
3,895,801 A * 7/1975 Baird ..... 273/350
3,989,250 A * 11/1976 Lakeman ..... 273/350
4,463,954 A * 8/1984 Panse et al. ..... 473/588
4,979,922 A * 12/1990 Clark ..... 446/46
5,941,529 A * 8/1999 Kinsey ..... 273/401
6,173,957 B1 * 1/2001 James, Sr. ..... 273/440
6,899,647 B2 * 5/2005 Chia ..... 473/466
2005/0006846 A1 * 1/2005 Roy ..... 273/336

* cited by examiner

*Primary Examiner*—Gene Kim
*Assistant Examiner*—M Chambers
(74) *Attorney, Agent, or Firm*—Dean A. Craine

(57) ABSTRACT

A water disk sports game that includes a pair of floating goals located at predetermined distances from each other in a designated boundary area. Each goal includes a vertical scoring pole that extends upward from a large floating base. In a first embodiment, the floating base is a hollow circular floating disk with an upper, diagonally aligned skirt surface that leads to a circular recessed cavity coaxially aligned with the scoring pole. Attached to the scoring pole is an elevated lid which creates a narrow gap between the lid and the top rim of the floating base. In another embodiment, the floating base is a partially submerged rim with radially aligned spokes and a center hub designed to receive the scoring pole. During use, a specially designed aquatic disk is given to one team whose objective is to throw the aquatic disk at the opposing team's scoring pole. If the aquatic disk contacts the scoring pole or is retained in the recessed cavity, a point is awarded to the offensive team or against the defensive team.

14 Claims, 12 Drawing Sheets

WATER DISK SPORTS GAME AND TARGET

This is a utility patent application which claims benefit of U.S. Provisional Application No. 60/993,547, filed on Sep. 12, 2007.

BACKGROUND OF THE INVENTION

1. Field of the Invention

This invention pertains to games that use a tangible projectile, and more particularly to such games played in a confined area in a body of water.

2. Description of the Related Art

Water polo is a popular team water sport in which the object of the game is to throw a ball, similar to a soccer ball into a net style goal located at one end of a swimming pool. Each time the ball is thrown into the goal, a point is awarded to the offensive team.

One drawback with water polo is that it requires a superior swimming technique and process, which few people have, and a ball that is difficult for children and women to throw with one hand while treading water or swimming. Therefore, the game is mostly limited to adult males with particularly strong swimming skills. Another drawback with water polo is that the game becomes physically confrontational as players fight for the ball that is difficult to grab and pass. Physical confrontation in water polo is further exacerbated by the slower tempo of the game, as well as, the size and configuration of the scoring area.

Swimmers at large, often enjoy playing catch with a flying disk while standing or treading in water. Generally, flying disks have a thin perimeter edge that allows the user to easily catch and throw the disk with one hand. Also, skipping the disk on the water or throwing the disk so that it flies just above the water is generally more entertaining than throwing a ball. Ideally, a disk that can either skip or skim on the water or fly just above the water would be most desirable.

What is needed is a water sport game played, either in shallow or deep water, by players standing, swimming and or treading water that uses a flying disk designed to skip or skim over the water or fly at a low elevation over the water to a special floating goal specially designed to capture the flying disk.

SUMMARY OF THE INVENTION

It is an object of the present invention to provide a floating target that can be used with an aquatic disc that is skipped over a body of water.

It is also an object of the invention to provide a water sport competition game played by opposing players that is similar to water polo.

It is another object of the present invention to provide such a game that uses a special aquatic disk designed to skip or skim across the water or fly at low elevation over the water.

It is further object of the present invention to provide such a game that uses special, 360 degree floating goals specifically designed to capture the aquatic disk skipping or skimming across the water or when thrown at a low elevation above the water.

These and other objects of the invention are met by the individual or team competition water game disclosed herein that includes a pair of floating goals located at a predetermined distance from each other in a designated area in a body of water, called a lagoon. The game includes a special aquatic disk capable of skipping or skimming across a body of water or at a low elevation above the water.

In the preferred embodiment, the lagoon is a designated playing area created within a floating boundary. The floating boundary may be square, rectangular, circular, oval or oblong. The lagoon is divided into three bays, two end bays and one middle bay. The three bays can be divided by designated marker buoys on the longitudinal sides of the floating boundary, or by overhead lines that extend transversely over the air space over the lagoon. The two floating goals are located in the opposite end bays. During the game, the rules require that the aquatic disk be passed between players only to and from designated bays within the lagoon. The aquatic disk may be thrown at the floating goal from any bay or from only selected bays. When the aquatic disk enters the floating goal, a point is warded awarded to the offensive team. The number of points awarded for a score may be determined by the bay where the scoring player was located. When the optional overhead lines are used, the rules may be modified so that the disk must fly under the overhead lines during play.

The goals are designed to withstand impacts from the aquatic disk during play. Each goal includes a floating base and a perpendicularly aligned score pole. The floating base not only acts as a buoyancy device for the scoring pole, but also serves as an obstacle or barrier, that prevents players from swimming or standing directly adjacent to the scoring pole and blocking shot attempts from any direction.

In the first embodiment, the floating base includes a floating circular body with a conical-shaped skirt surface that angles upward from the outer water edge to an elevated inner ledge, then drops to a central circular recessed cavity coaxially aligned with the body's center axis. The scoring pole is longitudinally aligned with the center axis. Located over the circular body is a coaxially aligned circular lid attached to the section of the scoring pole that extends above the circular body. The lid includes an optional downward conical-shaped lower surface which creates a narrow continuous opening between the lid and the elevated inner ledge of the skirt surface on the circular body. Formed centrally within the circular body, is the optional, opposing recessed cavity. In the preferred embodiment, the recessed cavity is more than twice the diameter of the aquatic disk so that the aquatic disk may be retained therein. Also, in the preferred embodiment, the lid is positioned on the scoring pole so that a narrow gap is created between the lid and the circular body which requires the aquatic disk be thrown at a relatively low elevation or at a low angle in order to contact the vertical scoring pole. In the preferred embodiment, a point is awarded to the offensive team when the aquatic disk makes contact with the scoring pole and to be retained in the recessed cavity.

To help keep the floating base afloat and upright in the water, additional buoyancy structures may be attached or integrally formed on the circular body.

In a second embodiment of the floating goal, the lid is eliminated so that a point is awarded whenever the aquatic disk makes contact with the scoring pole.

In another embodiment the floating base is a wheel-shaped rim structure with radially aligned spokes that support a centrally located vertical hub. The scoring pole is attached to the hub and extends vertically upward from the rim. An optional lid may be attached to the scoring pole so that the aquatic disk must be thrown at a low elevation and angle and contact the scoring pole in order to score.

In all the embodiments of the floating goals, the circular body and the rim structure are all sufficient in diameter to prevent players from positioning themselves close to the scoring pole. Defending players are required to swim around the perimeter edge of the floating goal to block shots. An anchor or tie line may be attached to the lower end of the scoring pole or to the floating base to hold the goal in a relatively fixed location in the lagoon.

In the preferred embodiment, the aquatic disk disclosed in U.S. Pat. No. 6,383,052 is used in the game. Such a disk is made of soft, closed cell foam rubber to reduce injuries caused by impacts. The aquatic disk has a smooth, low coefficient of friction lower surface that enables it to slide easily on the surface of the water while spinning. The aquatic disk has a curved outer perimeter edge with a sharp lower edge which intersects the disk's slightly curved parabolic bottom surface, therefore offering superior hydrodynamic efficiency at the air-water interface. Formed on the perimeter edge of the disk is a raised sidewall. Formed along the inside surface of the raised sidewall is a circular finger groove that enables the disk to be easily grasped and tossed with one hand when wet.

In the preferred method of playing the game, each player is allowed to wear a pair of special asymmetrical designed fins that provide optimal propulsion. These fins also feature a hoop-shaped perimeter blade which has a soft rounded blade profile with no sharp corners or edges. Players of different positions in the game, and locations of responsibility within the lagoon, may choose to wear specialized swim fins featuring different blade lengths or sizes. Shorter, smaller blades providing quicker pivoting and bursts may be more efficient for positions around the goal. Longer blades, providing higher speeds for distance swimming at the mid-lagoon positions may be desired. During setup, the goals are positioned at opposite end bays of the lagoon and sufficiently away from the back boundary lines and two-sided boundary lines so that each goal must be defended in 360 degrees. A timer and a referee table are setup on one side of the lagoon.

During use, players are assigned to one of two opposing teams. Next, the lagoon is designated and the boundary is setup, and the goals properly positioned on opposite sides of the lagoon. The players are then instructed to enter the water and the aquatic disk is then given to a player on one team who starts the game by "passing-off" the disk to the opposing team, similar to a football "opening kickoff". Then, the receiving team passes the aquatic disk between themselves trying to avoid interception by an opposing team player. When one player has an open shot at the goal, the aquatic disk is thrown towards the goal so that it skips or skims across the water or at a low elevation and angle substantially parallel to the top surface of the water. The disk then travels up the circular body's skirt surface and into the slot opening and contacts the scoring pole. When the disk contacts the scoring pole, a point is awarded to the offensive team or against the defensive team. When a lid is attached to the scoring pole, the rules may be modified so that a point is awarded if the aquatic disk is retained in the disk's recessed cavity.

DESCRIPTION OF THE PREFERRED EMBODIMENT(S)

Figure 1:
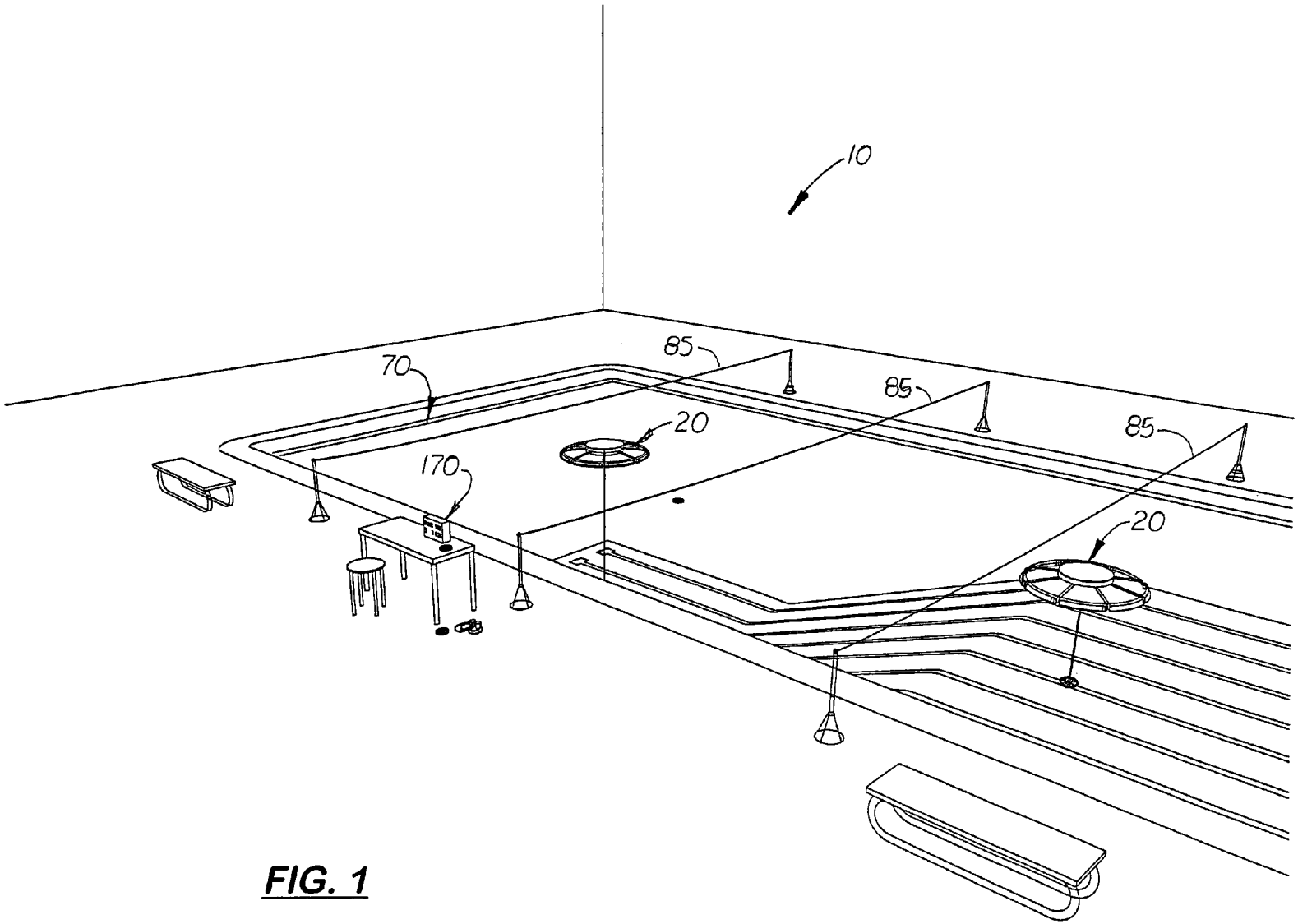
FIG. 1 is a perspective view of a swimming pool with a designated playing area with two water disk goals setup at opposite ends of the pool.

Referring to the accompany FIGS. 1-22, there is shown an individual or team competition water game 10 that includes a pair of floating goals 20 located at opposite sides of designated area, called a lagoon 70 and an aquatic disk 90, shown in FIGS. 18-22. When the aquatic disk 90 is skipped or skimmed across the water and makes contact with the scoring pole 45 attached to the floating base 22, a point is awarded to the offensive team or against the defensive team. Scoring pole 45, can be one continuous pole running through the central axis of the goal, or can be a series of pole segments axially adjoined thereto.

Lagoon

In the preferred embodiment, the lagoon 70 is a designated area created between a floating boundary 72. The floating boundary 72 may be square rectangular, circular, oval or oblong. In the preferred embodiment, the lagoon 70 is divided into three bays—two end bays 76, 78 and one middle bay 77 shown more clearly in FIGS. 2 and 3. The two floating goals 20 are located in the opposite end bays 76, 78. As shown in FIG. 1, the lagoon 70 may include optional elevated height limitation lines 85 that extend transversely over the lagoon 70. During play, the rules may state that the lines 85 create an upper region over the lagoon 70 that the aquatic disk 90 must fly under to prevent a violation or penalty.

Floating Goal or Target

In the preferred embodiment, the game is played with one or two floating goals 20. It should be understood, however, the floating goal 20 may be used outside the game as a target. In the first embodiment shown in FIG. 4, the floating goal 20 includes a wide floating base 22 with the perpendicularly aligned scoring pole 45 attached thereto. In the first embodiment, shown in FIG. 4, the floating base 22 is made of eight pie-shaped body sections 24A-H each with a curved, buoyancy edge section 26A-H, respectively. In the preferred embodiment, each edge section 26A-H is selectively attached to an adjacent body section 24A-H, thereby enabling the game operator to adjust the height of the floating goal 20 when floating in the water. Formed inside the floating base 22 is a center recessed cavity 28. Each body section 24A-H is made of polyethylene and includes a top upward diagonal surface 25A-H, respectively, that extends upward towards the recessed cavity 28. The buoyancy edge sections 26A-H are made of closed cell poly-ethylene foam and designed to provide additional buoyancy so the perimeter edge of the floating base 22 is slightly submerged and the center recessed cavity 28 is slightly elevated above the water line. In addition, the buoyancy edge sections 26A-H act as a cushion to protect the players against impact injuries with the goal 20 during play.

The recessed cavity 28 designed to house a rigid circular base plate 30 that acts as a foundation for a perpendicularly aligned anchor pole 32 that extends downward into the water and a perpendicularly aligned scoring pole 45 that extends upward into the air when the goal 20 is placed upright into the water. In the preferred embodiment, the base plate 30 that rests on a circular ledge 33 formed along the inside surface of the recessed cavity 28.

The vertical anchor pole 32 is hollow and includes an optional cord 34 that connects at one end to a weight 38 designed to hold the floating goal 20 in position in the lagoon 70 during play. The upper end of the cord 34 connects to an eyelet 36 that connects to a second cord 42 that extends downward from the scoring pole 45.

In the first embodiment, an upper, lid 50 is perpendicularly mounted and attached at an elevated position to the scoring pole 45. The lid 50 is located near the scoring pole's midline axis and includes a lower lid plate 52 and a convex circular upper lid plate 54 connected together along their perimeter edges. The surface of the lower lid plate 52 is designed to guide an aquatic disk 90 thrown into the gap 58 located between the lid plate set 50 and the upper surfaces of the body sections 24A-H shown in FIG. 5. A point may be awarded if the aquatic disk 90 contacts the scoring pole 45 and is retained in the recessed cavity 28. An optional flag pole 58 and flag 60 may be attached to the top end of the scoring pole 45 or to the top of the upper lid plate 54, to improve visibility.

Figure 6:
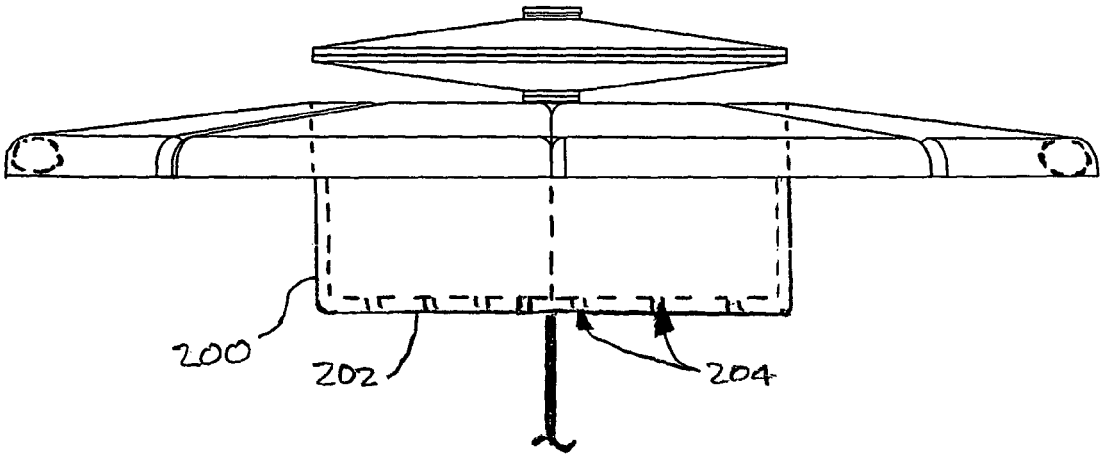
FIG. 6 is a side elevational view of the goal body used with the floating goal shown in FIG. 4.
Figure 7:
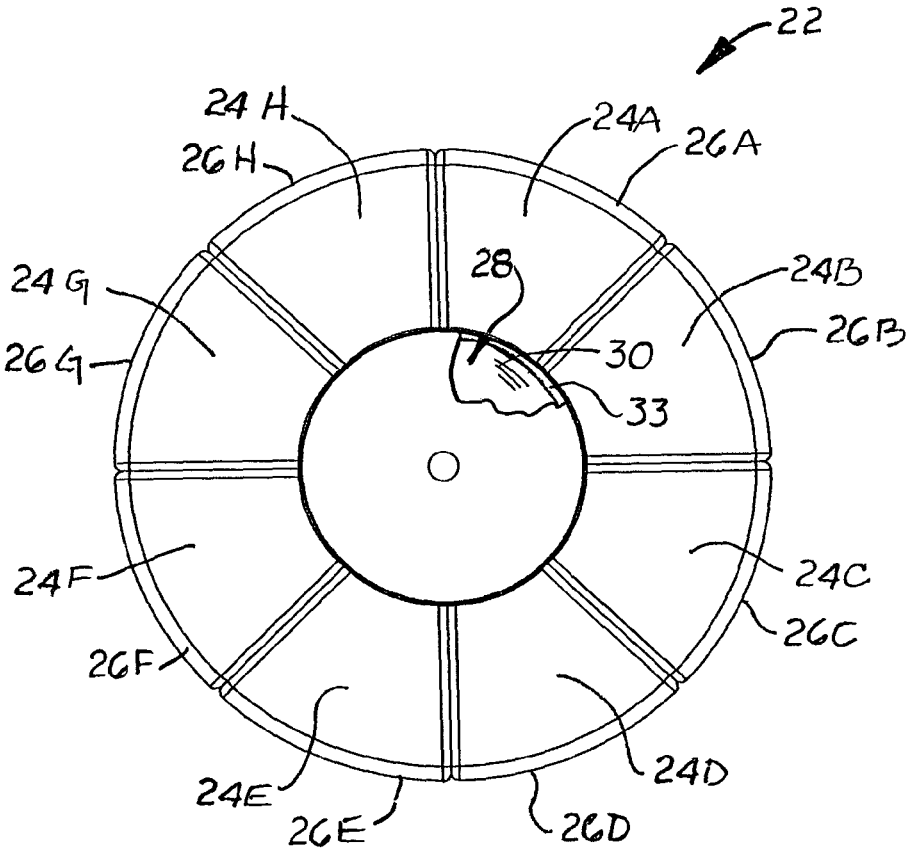
FIG. 7 is a top plan view of the goal body shown in FIGS. 4 and 6.

FIG. 6 is a side elevational view of the floating goal showing an optional cylindrical-shaped barrier 200 that extends through and below the floating base. The barrier 200 is designed to act as a structure used to stabilize or restrict lateral drift of the floating base in the body of water during play. The barrier 200 also acts as an underwater shield designed to prevent or discourage swimmers from swimming under the floating base during play. In the preferred embodiment, the bottom surface 202 of the barrier 200 is closed and includes a plurality of holes 204 that allow water to enter and escape from the barrier 200.

Figure 8:
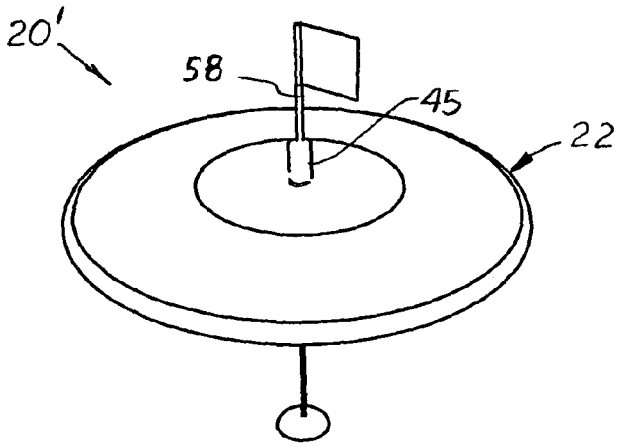
FIG. 8 is a side elevational view of a fourth embodiment of the floating goal that includes a conical solid body without a lid.
Figure 9:
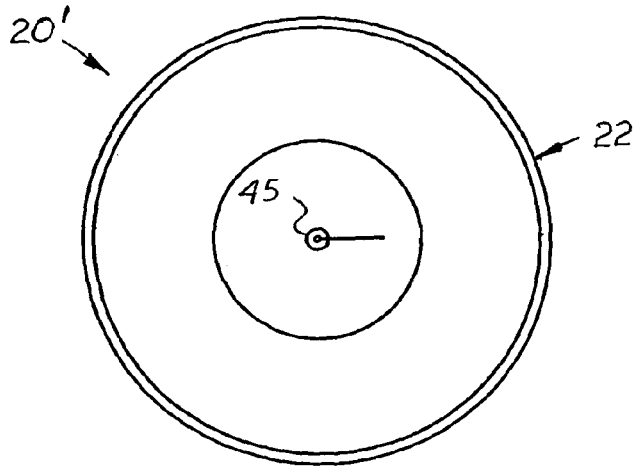
FIG. 9 is a top plan view of the floating goal shown in FIG. 8.
Figure 10:
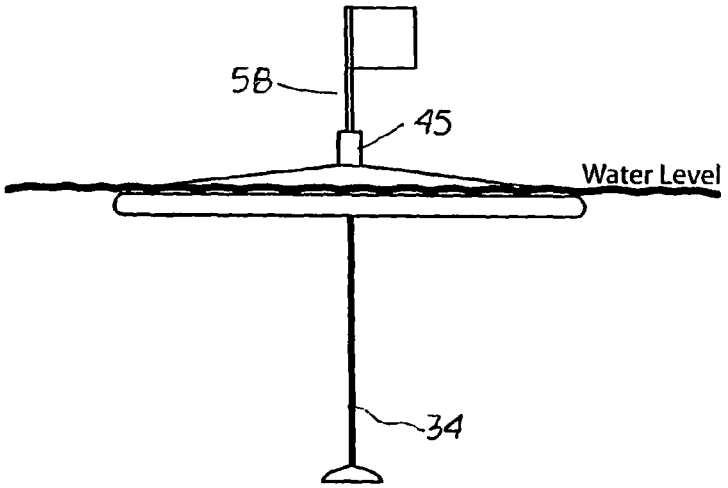
FIG. 10 is a side elevational view of the floating goal shown in FIGS. 8 and 9 partially submerged in the body of water.
Figure 11:
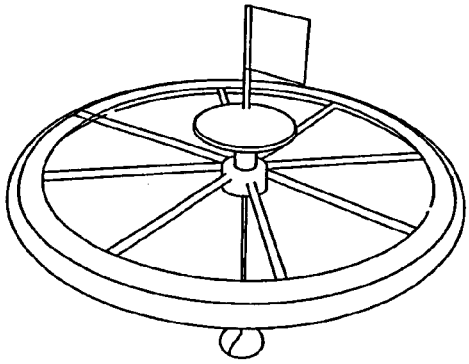
FIG. 11 is a perspective view of a lid attached, wheel floating goal.
Figure 12:
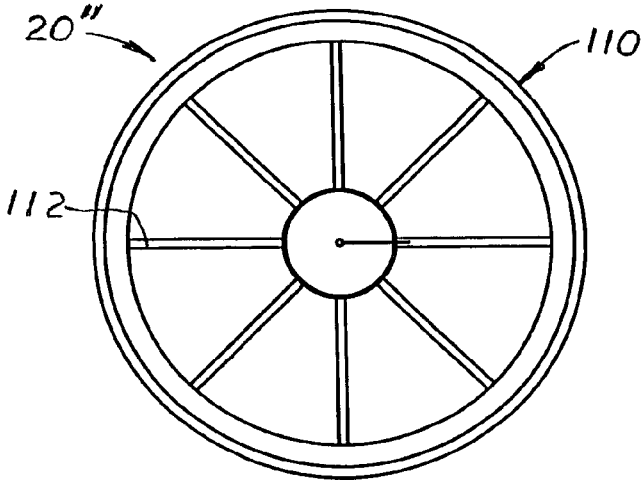
FIG. 12 is a top plan view of the floating goal shown in FIG. 11.
Figure 13:
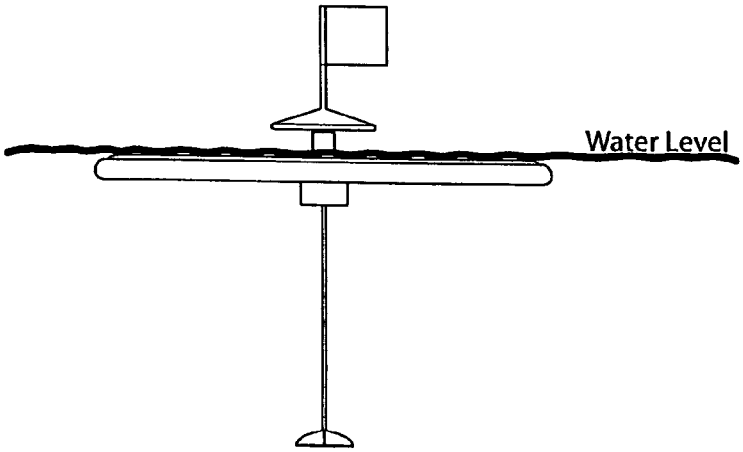
FIG. 13 is a side elevational view of the floating goal shown in FIGS. 11 and 12, showing the body completely submerged in the body in the water with only the scoring pole extending above the water.
Figure 14:
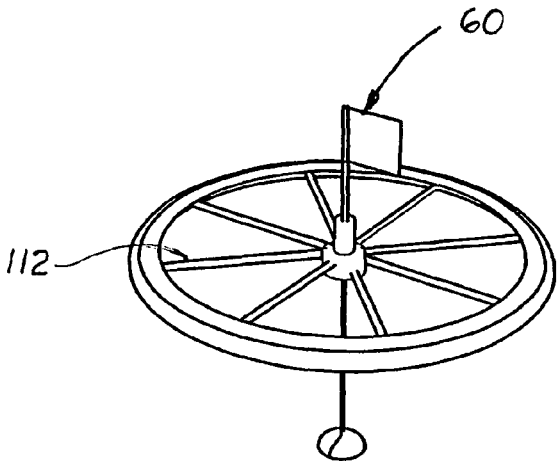
FIG. 14 is a perspective view of a third embodiment of the floating goal with a wheel shaped body and a center hub without a lid.
Figure 15:
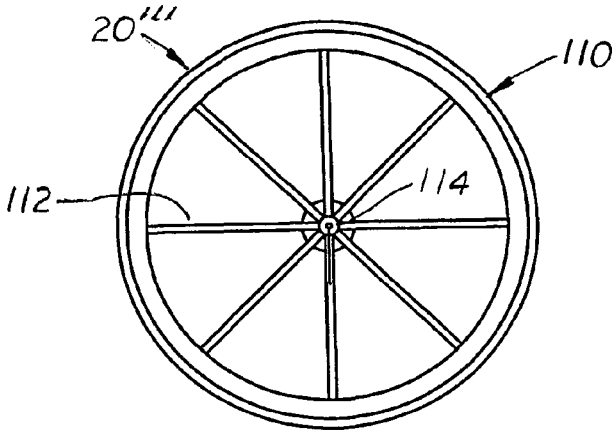
FIG. 15 is a top plan view of the floating goal shown in FIG. 14.
Figure 16:
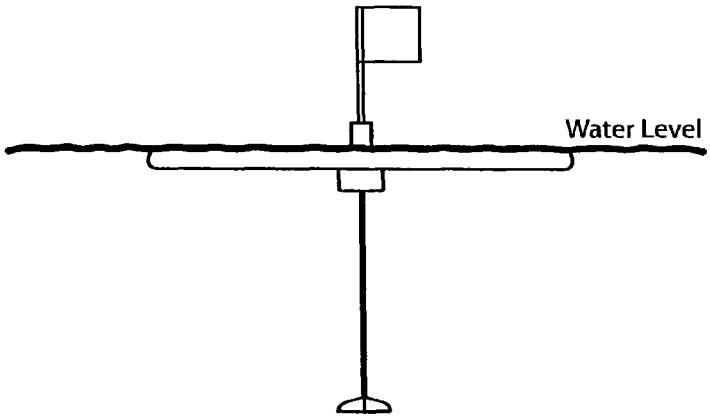
FIG. 16 is a side elevational view of the floating goal with completely submerged wheel body and only partially submerged scoring pole within the body of water.

A second embodiment of the floating goal, denoted 20' is shown in FIGS. 8-10, is identical to the first embodiment of the floating goal 20, accept that the lid 50 is eliminated. With this floating goal 20', a point is awarded whenever the aquatic disk 90 makes contact anywhere along the scoring pole 45.

FIGS. 11-13 and 14-16, show a third and fourth embodiment of the floating goal, denoted, 20" and 20'", respectively. Both floating goals 20" and 20'" replace the floating base 22 with a circular floating rim 110 with radially aligned spokes 112 that connect to a centrally located hub 114. The scoring pole 45 attaches to the hub 114 to hold it in a vertical aligned position above the floating goal 20" or 20'". In the floating goal 20", a lid 50 is attached to the top of the scoring pole 45 and underneath the flag pole 60, so that the aquatic disk 90 must be thrown at a low elevation and angle and contact the scoring pole 45 in order to score. In the floating goal 20'" the lid 50 is eliminated so that a point is awarded whenever the aquatic disk 90 makes contact with the scoring pole 45.

Figure 17:
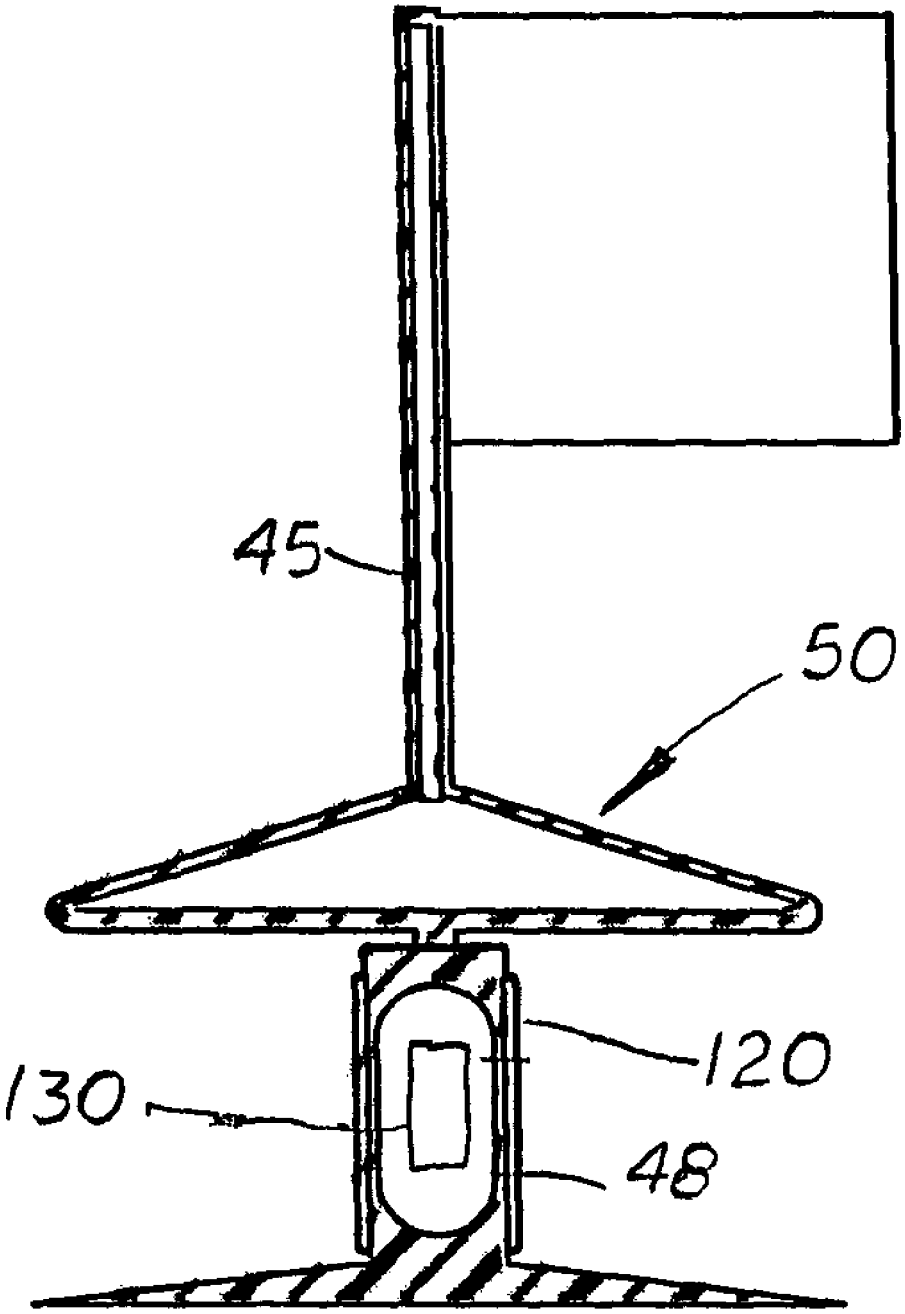
FIG. 17 is a side elevational view of the top lid area on a solid body floating goal with pressure sensitive pad surrounding the center post and a cavity formed inside the post in which an electronic scoring alarm is located.
Figure 18:
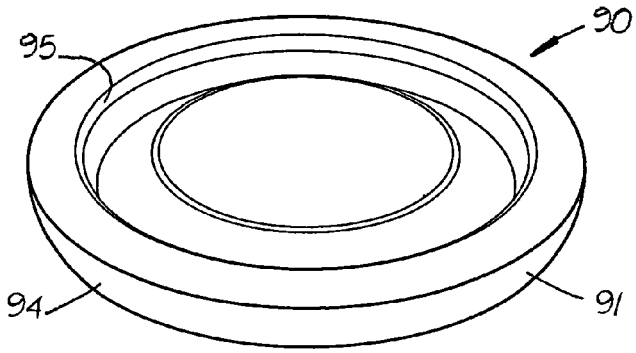
FIG. 18 is a perspective view of the aquatic disk.
Figure 19:
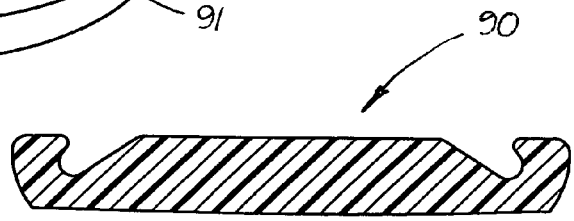
FIG. 19 is a sectional, side elevated view of an aquatic disk shown in FIG. 18.
Figure 20:
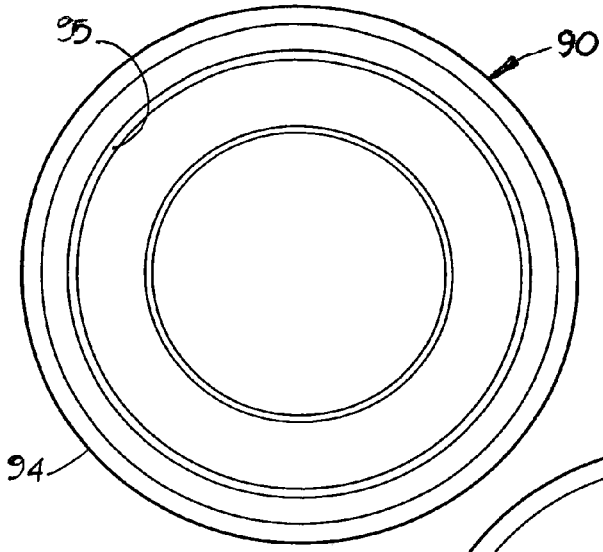
FIG. 20 is a top plan view of the aquatic disk shown in FIGS. 18 and 19.

FIG. 17 is a side elevational view of the lid 50 integrally formed on the scoring pole which is selectively attached to a modified support post 48. Located around the support post 48 is a pressure sensitive pad 120 which activates an alarm 130 mounted inside a watertight cavity 125 formed inside the support post 48.

In all of the embodiments of the floating goals 20, 20', 20", 20'" the buoyancy of the floating base 22 or rim 110 is sufficient so that the perimeter edge is slightly submerged or exactly at the water line 99. This allows a skimming aquatic disk 90 to move easily and freely from the water-air interface onto the ramp of the goal without disruption.

Both the floating base 22 and the rim 110 are sufficient in diameter so that players may not swim or stand immediately adjacent to the scoring pole 45. Because of the large diameter of the base 22 and rim 110, being on average, generally more than an arms reach in radius from the center scoring pole, players are forced to play more than an arms reach from the scoring pole. Therefore, in order to prevent a score, defensive players must position themselves directly between the goal and the opponent attempting a goal shot.

In the preferred embodiment, the floating base 22 and rim 110 are 60 to 120 inches in diameter. The recessed cavity 28 is approximately 12 to 36 inches in diameter and 1 to 4 inches deep. The aquatic disk 90 is approximately 6 to 12 inches in diameter and approximately ½ to 2 inches thick at its vertical center axis. The rim 110 is a continuous hollow tube approximately 1 to 5 inches in diameter and the spokes 112 are solid structures approximately 1 inch to 2 inches in diameter. The hub 114 is a hollow tube approximately 4 to 8 inches in length and 4 to 8 inches in diameter. The scoring pole 45 is approximately 4 to 8 inches in length and 2 to 5 inches in diameter.

The lid 50 is approximately 12 to 36 inches in diameter and approximately 1 to 6 inch thick at its center axis. The lid 50 is attached to the score pole 45 by a suitable adhesive or other mechanical means and is located approximately 4 to 8 inches above the floating base 22 or the rim 110. The flag pole 58 is approximately 1 to 3 feet in height and 1 to 2 inches in diameter.

Aquatic Disk

The aquatic disk 90 shown more clearly in FIGS. 18-22, is made of soft, closed cell foam rubber to reduce injuries caused by impacts. The aquatic disk 90 has a smooth, low coefficient of friction lower surface that enables it to slide easily on the surface of the water while spinning. The aquatic disk 90 has a curved outer perimeter surface 91 with a sharp lower edge 92 which intersects the disk's slightly curved parabolic bottom surface 93. The perimeter side surface of the aquatic disk 90 is thick thereby forming a raised sidewall 94. Formed along the inside surface of the raised sidewall 94 is a circular finger groove 95 that enables the aquatic disk 90 to be easily grasped and tossed with one hand when wet. In the preferred embodiment, the density of the aquatic disk 90 is between 6-20 lbs per cubic foot. While the aquatic disk 90 may be any size, in the preferred embodiment it measures 7.5 to 9 inches in diameter.

During use, two goals 20 selected are positioned on opposite end bays 76, 78 of the lagoon 70. The goals 20 are fixed in position with the weights 38 and/or with a tie downs (not shown). The goals 20 are located sufficiently away from the back lines 72, 73 and the two side lines 74, 75 so they must be defended in 360 degrees around the floating goal 20. When one player has an open shot at the goal 20, the aquatic disk 90 is thrown at a low elevation and at an angle substantially parallel to the water so that the aquatic disk 90 may skip along the water, travel up the surface and contact the scoring pole 45. In the first embodiment, the rules may be modified that require the aquatic disk 90 be retained in the recessed cavity 28 in order to score a point for the offensive team or against the defensive team.

Prior to the start of a game, players are assigned to one of two opposing teams The aquatic disk 90 is then given to players on one team, at which time they pass off to the opposing team to start the game. The offensive team then passes the aquatic disk 90 between themselves trying to avoid interception by an opposing team player. When one player has an open view of the goal 20, the aquatic disk 90 is thrown at the goal 20 at an angle substantially parallel to the water so that the aquatic disk 90 may skip along the water and contact the scoring pole 45.

Figure 21:
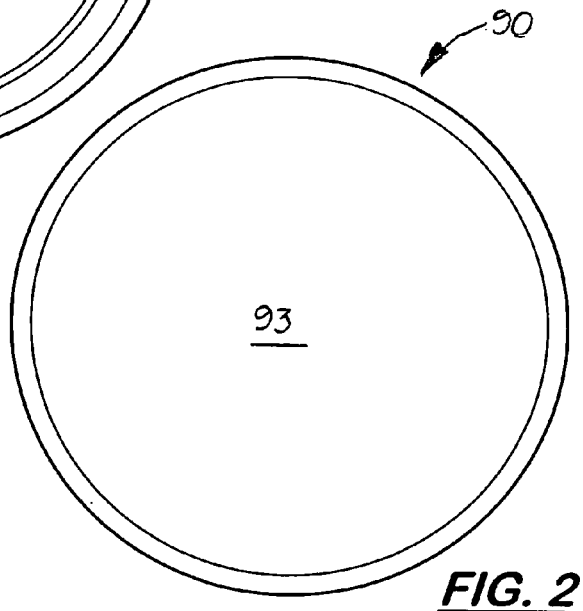
FIG. 21 is a bottom plan view of the aquatic disk shown in FIGS. 18-20.
Figure 22:
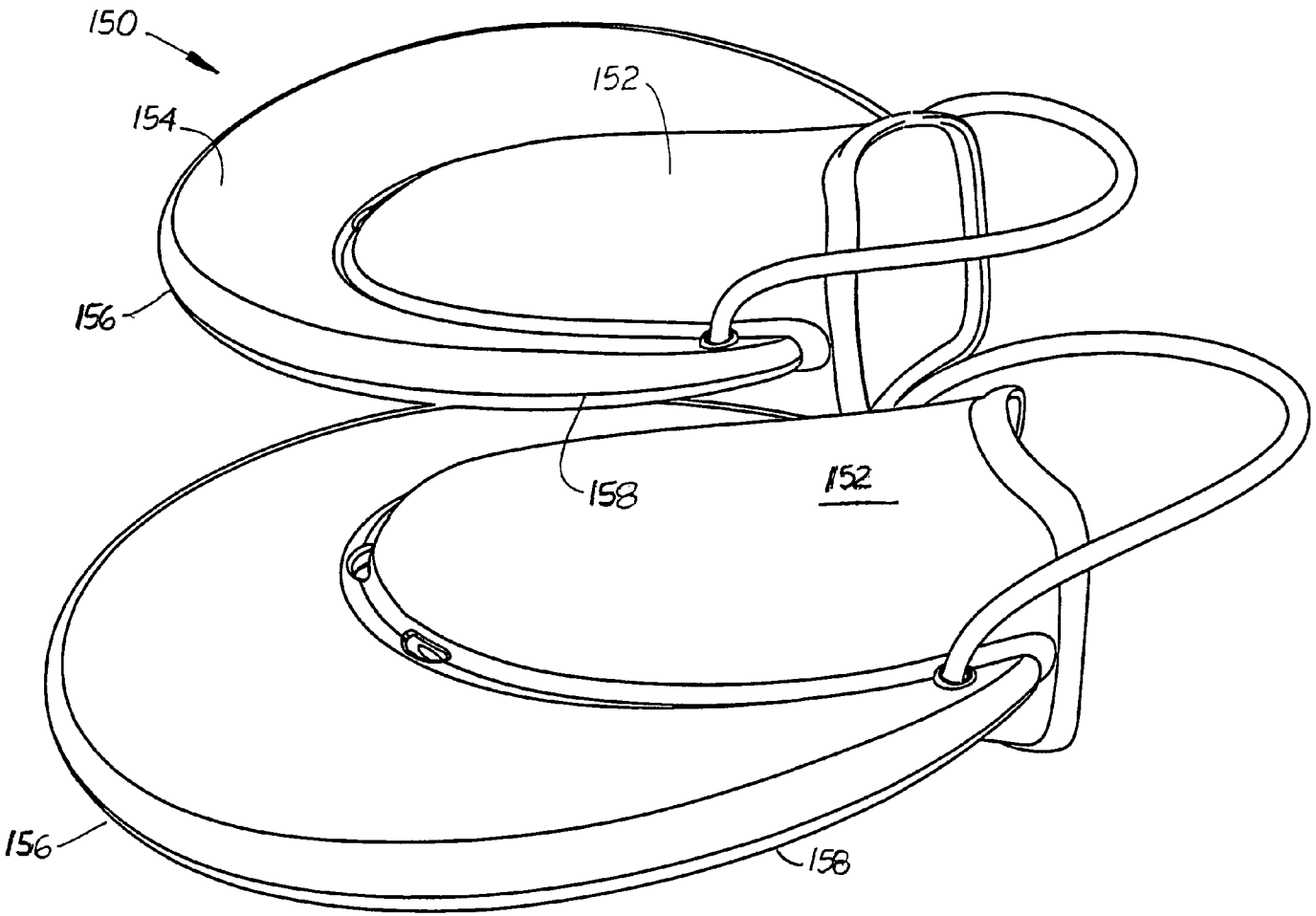
FIG. 22 is a perspective view of two swimming fins.

In the preferred embodiment of the game, each player is allowed to wear fins 150 that allow them to swim quickly, more elusive, and swirling so that a score can be made from any side of the goal. As shown in FIG. 21, special fins 150 are provided with the game that provides greater mobility so that players may use their legs and feet rather than their hands to catch and pass the aquatic disk 90. In the preferred embodiment, the fins 150 have an asymmetrical design with an offset foot pocket 152 relative to the center axis of the blade 154, for increased efficiency, acceleration and power. On such fins 150, the shape of the blade 154 is more rounded and contoured than conventional fins to make the fins more versatile for surface water sport use. The shape and position of the blade 154, in relationship to the foot-pocket 152, and novel strap configuration 155, allow this fin design to enhance not only forward propulsion of the participant, but also pivoting, spinning, stopping, turning and sudden changes in direction. Each fin 150 includes a soft, rounded edge blade 156 and side rails 158, which helps safeguard opponents and other team members from abrasion and bruising, caused by incidental contact. Also, each blade 154 is wider and shorter relative to the foot pocket 152 than used with conventional fins.

The lagoon 70 is created by a floating boundary 71 with two backlines 72, 73 and two sidelines 74, 75 all made of molded plastic or foam segments 80 tied or strung together with ropes 82. Optional lines 84 or anchors (not shown) may be used to hold the boundary 71 in place in the pool or lake.

Game Mechanics

Figure 2:
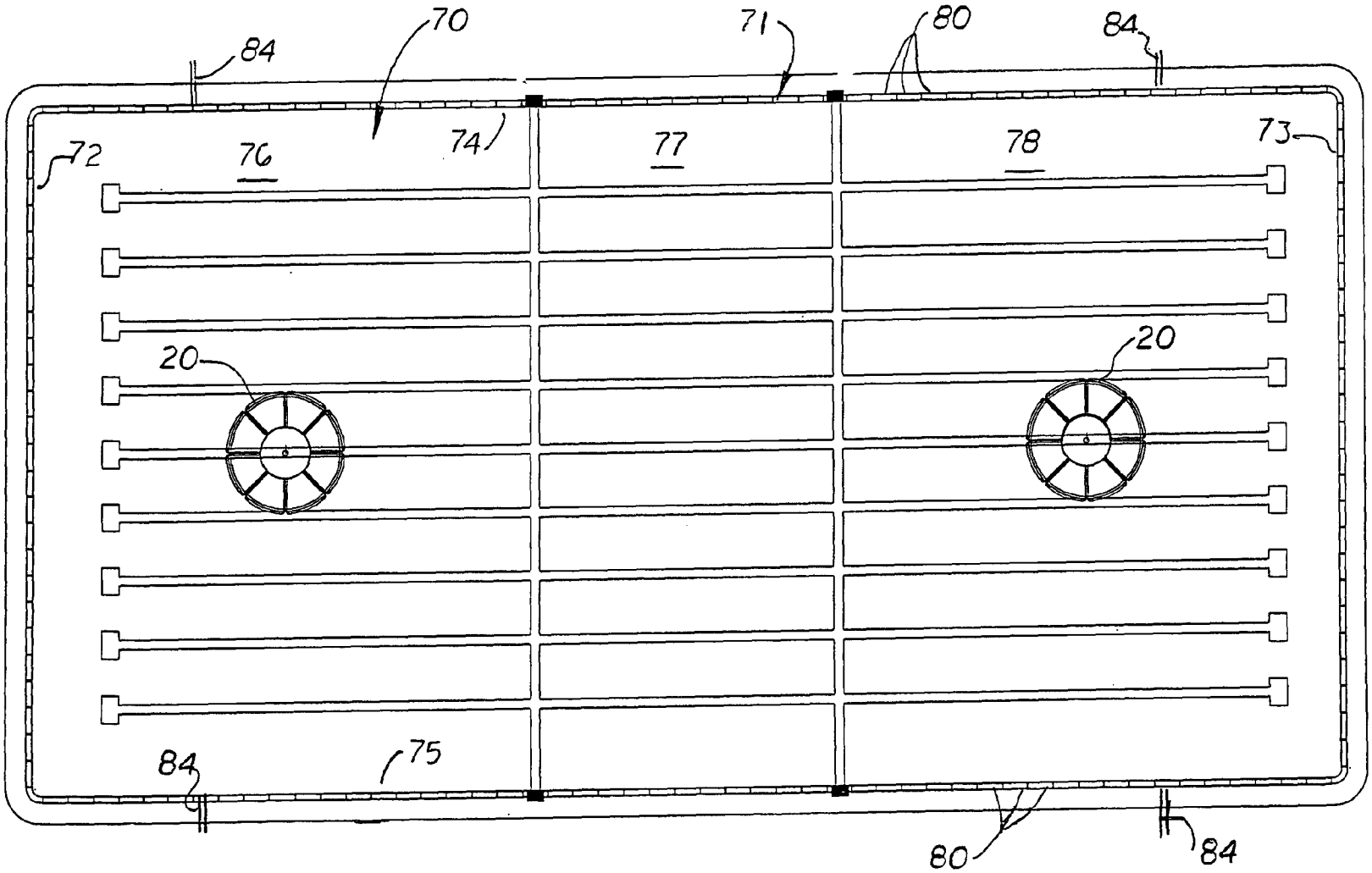
FIG. 2 is a top plan view of the swimming pool with a rectangular lagoon setup therein.
Figure 3:
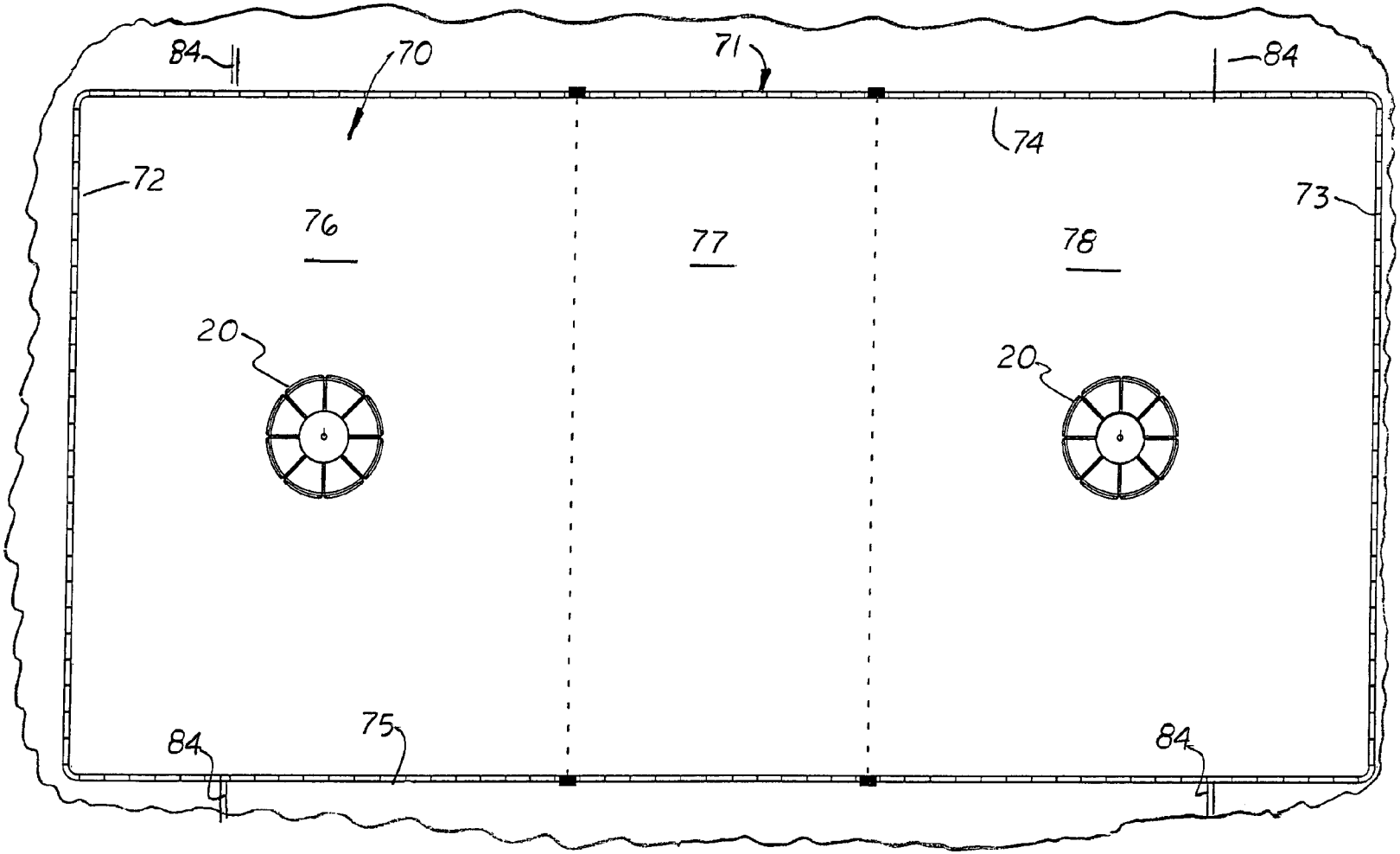
FIG. 3 is a top plan view of a rectangular lagoon setup in an open body of water.
Figure 4:
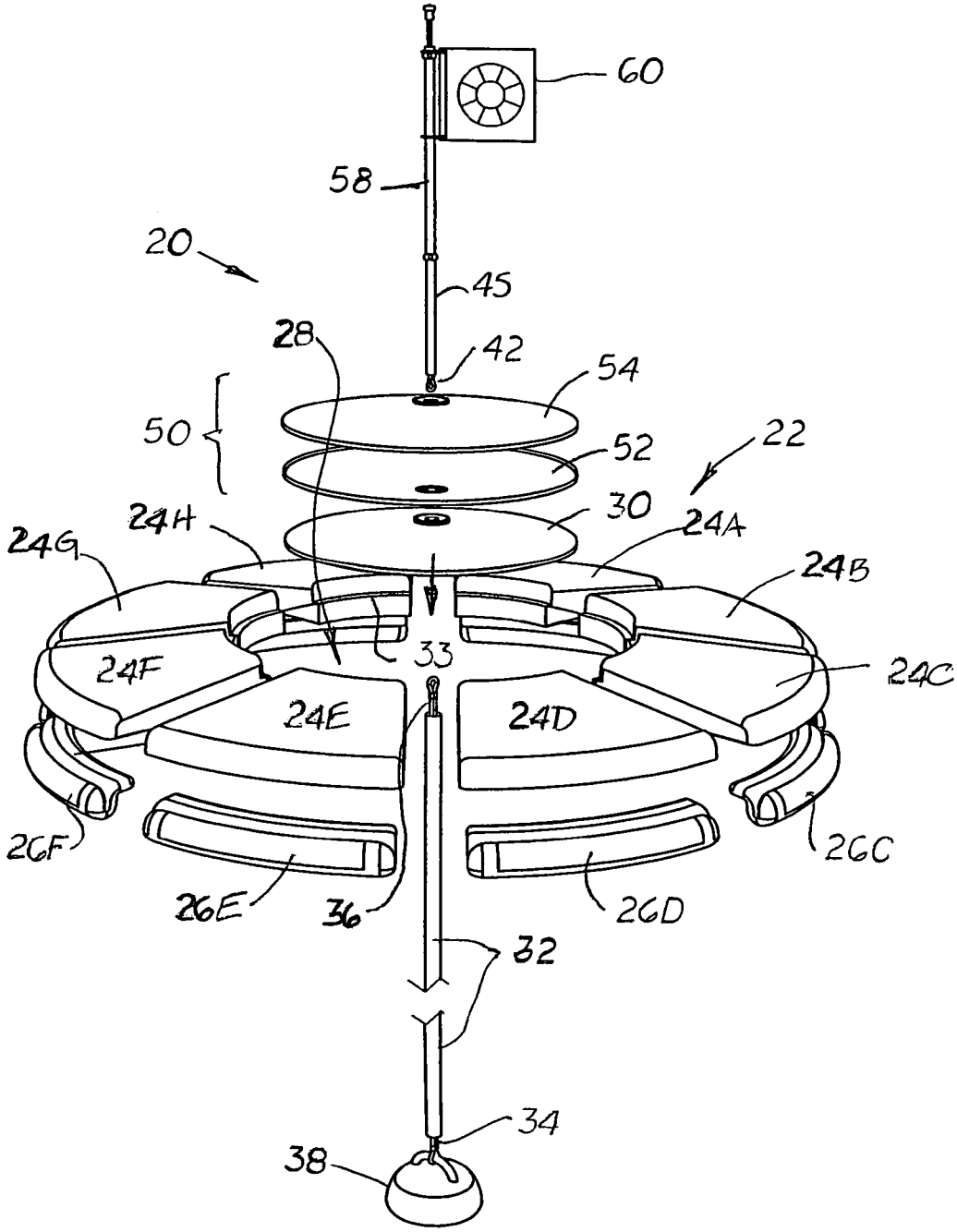
FIG. 4 is an exploded, perspective view of a lid attached to a scoring pole that extends through a solid-body floating goal.
Figure 5:
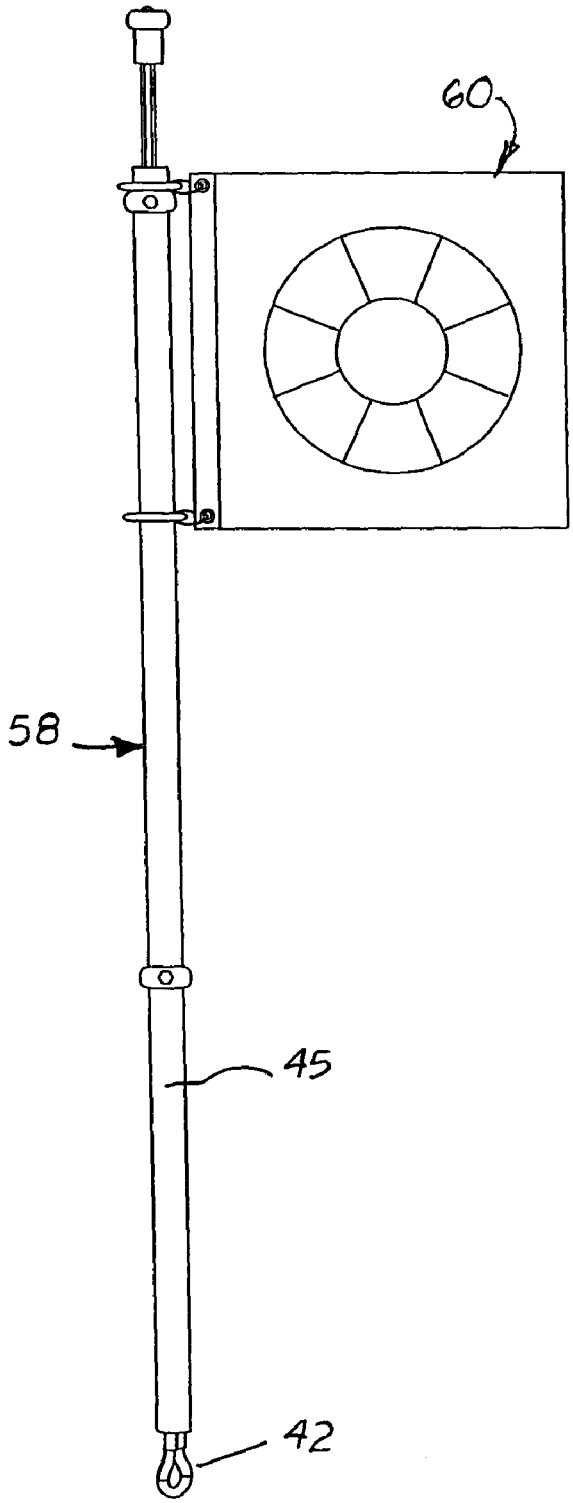
FIG. 5 is a side elevation of a flag pole.

Before playing and beginning, a designated lagoon 70 in a body of water is selected. In the preferred embodiment, the lagoon 70 is rectangular as shown in FIGS. 1 and 2. In FIGS. 1 and 2, the two backlines 72, 73 are identical in length. The two sidelines 74, 75 are identical in length and approximately ⅓ to ½ longer in length than the backlines, thereby forming a rectangular-shaped lagoon 70. The number of players depends on the size of the lagoon 70 and the age of the players. For an Olympic size pools, each team has up to 10 players. For 25 meter pools, each team may have 6 players. There are optional height limitation lines 85 that may run transversely across and over the lagoon 70, or there may be markers on the side boundaries designating divisions of the lagoon. During play, the lines 85 create fore, mid, and aft lagoon zones or "bays" which designate areas of limitation or advantage. For example, these optional overhead "goal" lines may designate "off-sides" to a particular team, while the mid-lagoon line may designate a two point conversion when goal attempts precede it. They also create overhead lines 85 over which the aquatic disk 90 can not be thrown. Also, as an alternative, water-level bay-markers 86 may be use along the boundary instead of over-head lines, to designate bay locations, and subsequent area definitions, for rules, regulations or limitations to types of action in the course of the game.

The players throw or slide the aquatic disk 90 on the water in any direction to a team mate. The players can pass in many different methods, forehand, backhand, overhand to avoid a defender. Players can lob a high lag to a team mate well above the rope plane as long as the lag does not proceed over one of the height limitation lines 85.

In the preferred embodiment, the game 10 includes a timer 170 that encourages the aquatic disk 90 to move more quickly and often between players. The aquatic disk 90 will need to pass over a portion of the floating goal 20 or under and beyond the transverse goal lines or proceed to the aft lag area within a designated time period, i.e. 30 seconds. A time limitation may also be implemented to restrict a player from simply holding the aquatic disk 90 for more than 5 seconds without passing.

During play, the aquatic disk 90 can be held with one hand only. A player can not swim and hold the aquatic disk 90. The aquatic disk 90 can only be advanced by skipping or skimming the disk away, then swimming to retrieve it (comparable to dribbling a soccer or basketball) or, by passing, skipping or skimming the aquatic disk 90 to another player towards the goal. The aquatic disk 90 may only be advanced by passing or lagging the aquatic disk 90 on the water and below the overhead height limitation lines 85. An alternate method of controlling the height of the aquatic disk 90 off the water in forward direction is to regulate all forward passes or lags to a "downward" trajectory, such that the aquatic disk 90 must always be loosing altitude once released by the player. An exception to this rule would be passes or lags tossed away from the goal 20, those therefore being thrown rearward to a transverse plane across the lagoon 70. This exception would allow offensive players a method of retreat should they be, surrounded by defensive players. In either forward or rearward passes, an offensive player may rise up out of the water, as high as capable, in order to gain altitude with his hand and the aquatic disk 90 at the point of release, in order to pass over an opponent. A third way of regulating the air travel distance of the aquatic disk 90 is to require all lags from a rear bay to touch down in the middle bay 77 before moving to the opposing end bay 76 or 78. And secondly, to require all passes to make contact with the water before being caught by a team mate. These rules combined increase the play on the water overall between players of the same team.

In summary, the water disk game 10 is faster, safer, and more fun to play and watch than other types of water team sports. It is also easy to learn and the aquatic disk 90 is easier to catch and throw with one hand. Also, the fins 150 and optional buoyancy belts or vests (not shown) make swimming and playing much easier. It also has less confrontation with less physical contact especially around the goal and in scoring as compared to water polo. The game 10 is more exciting because it allows scoring from all directions and therefore spreads both the offense and defense players more broadly throughout the lagoon. Because of the use of swim fins 150 and because the goals 20 must be defended in 360 degrees, the game 10 is faster and may be played in a bigger body of water, than water polo. Adult regulation water polo is played in approximately ⅔rds of a 50 meter Olympic pool, whereby the present game 10 can be played on a full 50 meter pool when adult athletes are participating. When playing this game 10, the aquatic disk 90 is not always well seen when moving toward the goal, because it is skimming across the water, therefore, as in ice hockey, many fast and elusive plays at the goal can be achieved, with precision, high speed and deception. In short, this game 10 of aquatic disk 90, though having no barrier or prerequisite to entry, also possesses a high level of performance and action when played with experience and skill.

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A water disk sports game, comprising:

a. a designated lagoon in a body of water, said lagoon created by two side lines, two back lines and at least one transversing center line;

b. at least one pair of floating goals located, inside said lagoon at predetermined distances from said back lines and on opposite sides of said lagoon, each said goal including a large, low profile floating base with a vertical, centrally aligned scoring pole, further including a horizontal lid attached to said scoring pole, said lid being located on said score pole so that a gap is formed between said horizontal lid and the floating base, said floating base includes an upper diagonal surface that terminate inside said base to form a circular recess cavity, said floating base having sufficient amount of buoyancy when placed in the body of water to at least partially support said scoring pole in a vertical, upright position in the body of water;

c. means for anchoring said floating goal in a fixed position in said lagoon; and, d. an aquatic disk capable of skipping across a body of water and contacting said scoring pole, said aquatic disk being made of foam and able to float and includes a raised sidewall that can be easily grasped with a wet hand.

2. The water disk sports game as recited in claim 1, wherein said floating base is circular and has a sufficient diameter so that a player positioned outside said floating base, may not reach inward and touch said scoring pole.

3. The water disk sports game as recited in claim 1, wherein said scoring pole centrally aligned on said floating base.

4. The water disk sports game as recited in claim 3, further including a center recessed cavity formed in said floating base and surrounding said scoring pole.

5. The water disk sports game as recited in claim 1, further including a lid attached to said scoring pole, said lid being located on said score pole so that a horizontal gap is formed between said lid and the floating goal.

6. A floating target for a skipping projectile on a body of water, comprising:

a. a wide, circular floating body made of a plurality of body sections each with a curved, buoyancy edge section, each said body section includes a top upward diagonal surface that extends upward and terminates to form a circular recessed cavity;

b. a scoring pole perpendicular aligned and attached to said floating body; and, c. an upper lid perpendicularly mounted and attached at an elevated position to said scoring pole and above said body sections thereby creating a horizontal gap located between said lid and said body sections, whereby when a disc projectile is thrown into said horizontal gap and retained inside said recessed cavity a scoring goal is made.

7. The floating target as recited in claim 6, further including at least one buoyancy member attached to said floating base capable of improving the buoyancy of said floating base when floating in a body of water.

8. The floating target as recited in claim 7, wherein said buoyancy member is a closed cell foam.

9. The floating target as recited in claim 6, further including an anchor pole attached to said floating base and extending downward and into the body of water below said floating base.

10. The floating target as recited in claim 9, further including a barrier that extends downward from said floating base, said barrier being sufficient in size and shape to stabilize said floating base and to prevent swimmers from swimming under said floating base.

11. The floating target as recited in claim 10, further including anchor cord extend through said anchor cord and a weight attached to said anchor cord to hold said floating base in a fixed position in a body of water.

12. The floating target as recited in claim 6, further including a flag pole and a flag attached to the upper end of said scoring pole or said upper lid.

13. The floating target as recited in claim 6, further including an alarm that is activated when contact is made against said scoring pole.

14. A floating target for a skipping projectile on a body of water, comprising:

a. a wide floating base that includes a floating outer rim, a center hub, and a plurality of radially aligned spokes that extend between said outer rim and said center hub;

b. a scoring pole perpendicular aligned and attached to said floating base; and, c. an upper lid perpendicularly mounted and attached at an elevated position to said scoring pole and above said spokes, said upper lid creates a horizontal gap located between said lid and said spokes in which a disc projectile may be thrown into said horizontal gap and make contact with a section of said pole located inside said horizontal gap.

* * * * *